US008119203B2

(12) United States Patent
Hise et al.

(10) Patent No.: US 8,119,203 B2
(45) Date of Patent: Feb. 21, 2012

(54) METHOD OF TREATING A SURFACE TO PROTECT THE SAME

(75) Inventors: Robert L. Hise, Humble, TX (US); Geoffrey E. Scanlon, Humble, TX (US); Joseph Bergmeister, III, Kingwood, TX (US); Daniel B. Knorr, Humble, TX (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 741 days.

(21) Appl. No.: 11/420,904

(22) Filed: May 30, 2006

(65) Prior Publication Data

US 2006/0275551 A1 Dec. 7, 2006

Related U.S. Application Data

(60) Provisional application No. 60/686,792, filed on Jun. 2, 2005.

(51) Int. Cl.
*C10G 35/00* (2006.01)
*B05D 3/00* (2006.01)
*B05D 3/02* (2006.01)

(52) U.S. Cl. ..... 427/383.1; 427/191; 427/205; 427/294; 427/452; 427/455; 419/30; 419/32; 419/34; 208/133

(58) Field of Classification Search ..... 208/133; 427/383.1, 294, 191, 205, 452, 455; 419/30, 419/32, 34

See application file for complete search history.

(56) References Cited

U.S. PATENT DOCUMENTS

| | | | |
|---|---|---|---|
| 2,882,244 | A | 4/1959 | Milton |
| 3,130,007 | A | 4/1964 | Breck |
| 3,216,789 | A | 11/1965 | Breck et al. |
| 5,405,525 | A | 4/1995 | Heyse et al. |
| 5,406,014 | A | 4/1995 | Heyse et al. |
| 5,413,700 | A | 5/1995 | Heyse et al. |
| 5,516,421 | A | 5/1996 | Brown et al. |
| 5,593,571 | A | 1/1997 | Heyse et al. |
| 5,674,376 | A | 10/1997 | Heyse et al. |
| 5,676,821 | A | 10/1997 | Heyse et al. |

(Continued)

OTHER PUBLICATIONS

"Publication Information and Contributors," Metals Handbook Desk Edition, ASM International, 2002, 2nd Edition, pp. 1-10.

(Continued)

*Primary Examiner* — Prem C Singh
(74) *Attorney, Agent, or Firm* — Conley Rose, P.C.; Rodney B. Carroll; Chad Walter

(57) ABSTRACT

A method of treating a substrate by applying a layer of at least one metal to the substrate to form an applied metal layer on the substrate and followed by curing of the applied metal layer at sub-atmospheric pressure to form a metal protective layer. A method of treating a substrate by applying a layer of at least one metal to a substrate of an unassembled component of a reactor system to form an applied metal layer on the substrate of the unassembled component and curing the applied metal layer on the substrate of the unassembled component to form a metal protective layer. A method of treating a substrate by applying a layer of at least one metal to the substrate to form an applied metal layer, curing the applied metal layer at a first temperature and pressure for a first period of time, and curing the applied metal layer at a second temperature and pressure for a second period of time, wherein the curing forms a metal protective layer.

20 Claims, 2 Drawing Sheets

U.S. PATENT DOCUMENTS

| | | | |
|---|---|---|---|
| 5,723,707 | A | 3/1998 | Heyse et al. |
| 5,807,842 | A | 9/1998 | Buscemi et al. |
| 5,849,969 | A | 12/1998 | Heyse et al. |
| 5,863,418 | A | 1/1999 | Heyse et al. |
| 6,019,943 | A | 2/2000 | Buscemi et al. |
| 6,139,909 | A | 10/2000 | Hagewiesche |
| 6,419,986 | B1 | 7/2002 | Holtermann et al. |
| 6,548,030 | B2 | 4/2003 | Heyse et al. |
| 6,551,660 | B2 | 4/2003 | Holtermann et al. |
| 6,682,780 | B2 * | 1/2004 | Tzatzov et al. ..... 427/383.1 |

OTHER PUBLICATIONS

International Search Report and Written Opinion, PCT/US06/020723, Dec. 4, 2006, 18 pages.

* cited by examiner

METHOD OF TREATING A SURFACE TO PROTECT THE SAME

CROSS-REFERENCE TO RELATED APPLICATIONS

This application claims priority to U.S. Provisional Patent Application Ser. No. 60/686,792 filed on Jun. 2, 2005, which is hereby incorporated by reference in its entirety.

STATEMENT REGARDING FEDERALLY SPONSORED RESEARCH OR DEVELOPMENT

Not applicable.

FIELD OF THE INVENTION

1. Field of this Disclosure

This invention relates generally to methods of treating a substrate with a metal protective layer to protect same. More specifically, this invention relates to protective layers for a surface of a metal substrate to prevent degradation thereof.

2. Background of this Disclosure

Chemical reagents in reactor systems often have adverse secondary effects on the reactor metallurgy. Chemical attack on a metal substrate of the various components of reactor systems, such as furnace tubes, reactor vessels, or reactor internals may result in the degradative processes of carburization, metal dusting, halide stress corrosion cracking, and/or coking.

"Carburization" refers to the injection of carbon into the substrate of the various components of a reactor system. This carbon can then reside in the substrate at the grain boundaries. Carburization of the substrate can result in embrittlement, metal dusting, or a loss of the component's mechanical properties. "Metal dusting" results in a release of metal particulates from the surface of the substrate. "Coking" refers to a plurality of processes involving the decomposition of hydrocarbons to essentially elemental carbon. Halide stress corrosion cracking can occur when austenitic stainless steel contacts aqueous halide and represents a unique type of corrosion in which cracks propagate through the alloy. All of these degradative processes alone or in combination can result in considerable financial losses in terns of both productivity and equipment.

In the petrochemical industry, the chemical reagents and hydrocarbons present in hydrocarbon conversion systems can attack the substrate of a hydrocarbon conversion system and the various components contained therein. "Hydrocarbon conversion systems" include isomerization systems, catalytic reforming systems, catalytic cracking systems, thermal cracking systems and alkylation systems, among others.

"Catalytic reforming systems" refer to systems for the treatment of a hydrocarbon feed to provide an aromatics enriched product (i.e., a product whose aromatics content is greater than in the feed). Typically, one or more components of the hydrocarbon feed undergo one or more reforming reactions to produce aromatics. During catalytic reforming a predominantly linear hydrocarbon/hydrogen feed gas mixture is passed over a precious metal catalyst at elevated temperatures. At these elevated temperatures, the hydrocarbons and chemical reagents can react with the substrate of the reactor system components to form coke. As the coke grows on and into voids of the substrate it impedes the flow of hydrocarbons and the transfer of heat across the reactor system component. In time, the coke can eventually break free from the substrate causing damage to downstream equipment and restricting flow at downstream screens, catalyst beds, treater beds, and exchangers. When the catalytic coke breaks free, a minute to atomic sized piece of metal may be removed from the substrate to form a pit. Eventually, the pits will grow and erode the surface of the hydrocarbon conversion system and components contained therein until repair or replacement is required.

Traditionally, the hydrocarbon feeds in reforming reactor systems contain sulfur, which is an inhibitor of degradative processes such as carburization, coking and metal dusting. However, zeolitic catalysts developed for use in catalytic reforming processes are susceptible to deactivation by sulfur. Thus, systems employing these catalysts must operate in a low-sulfur environment that affects the substrate metallurgy negatively by increasing the rate of degradative processes such as those discussed previously.

An alternative method for inhibiting degradation in a hydrocarbon conversion system, such as in a catalytic reformer, involves formation of a protective layer on the substrate surface with a material that is resistant to the hydrocarbon feeds and chemical reagents. These materials form a resistant layer termed a "metal protective layer" (CPL). Various metal protective layers and methods of applying the same are disclosed in U.S. Pat. Nos. 6,548,030, 5,406,014, 5,674,376, 5,676,821, 6,419,986, 6,551,660, 5,413,700, 5,593,571, 5,807,842 and 5,849,969 each of which is incorporated by reference herein in its entirety.

An MPL may be formed by applying a layer of at least one metal on a substrate surface to form an applied metal layer (AML). The AML may be further processed or cured at elevated temperatures as needed to form the MPL. The uniformity and thickness in addition to the composition of the MPL are important factors in its ability to inhibit reactor system degradation. The current processes for coating the reactor system substrate surfaces and forming an MPL thereon necessitates shutdown of the reactor system. Atomizing the time required to coat a substrate surface to form an AML and to cure the AML to form an MPL would minimize the expenses associated with a shutdown.

Given the foregoing problems, it would be desirable to develop a method of increasing the resistance of reactor systems to degradative processes such as carburization, halide stress corrosion cracking, metal dusting, and/or coking. It would also be desirable to :develop a methodology for the formation of an MPL on a reactor system substrate that reduces the cost associated with the reactor system shutdown. Finally, it would be desirable to develop a methodology for retrofitting or repairing degraded components of a reactor system.

BRIEF SUMMARY OF SOME OF THE PREFERRED EMBODIMENTS

Disclosed herein is a method of treating a substrate, comprising applying a layer of at least one metal to the substrate to form an "applied metal layer" (AML) on the substrate followed by curing of the. AML at sub-atmospheric pressure to form a metal protective layer (MPL) on the substrate. The MPL optionally may be further processed by mobilization and sequestration processes. The pressure may be from about 14 psia (97 kPa) to about $1.9\times10^{-5}$ psia (0.13 Pa) during the curing process. The AML may be applied as a paint, coating, plating, cladding, or other methods known to one of ordinary skill in the art. The AML may comprise tin, antimony, germanium, bismuth, silicon, chromium, brass, lead, mercury, arsenic, indium, tellurium, selenium, thallium, copper, intermetallic alloys, or combinations thereof The AML may have a thickness of from about 1 mil (25 μm) to about 100 mils (2.5 mm). After curing the MPL may have a thickness of from about 1 μm to about 150 μm. The substrate may comprise iron, nickel, chromium or combinations thereof. The AML may be cured in a reducing environment to form the MPL. The MPL may optionally comprise an intermediate bonding layer which anchors the layer to the substrate. In some instances the bonding layer may be a nickel-depleted bonding layer. In other instances the bonding layer may comprise inclusions of the stannide layer.

Further disclosed herein is a method of treating a substrate, comprising applying a layer of at least one metal to a substrate of an unassembled component of a structure to form an AML on the substrate of the unassembled component and followed by curing of the AML on the substrate of the unassembled component to form an MPL on the substrate. The MPL optionally may be further processed by mobilization and sequestration processes. The unassembled component may be a reactor system component. The application of the metal layer, the curing of the AML, or both may be performed at a location other than a final assembly site for the structure. The unassembled component may be transported prior to or after any of the individual process steps described herein including but not limited to applying the AML, followed by curing of the AML to an MPL, mobilization and sequestration processes, etc. The unassembled component may be removed from an assembled structure prior to the application of the metal layer and the curing of the AML. The unassembled component may be a repair or replacement part for an assembled structure. The curing of the AML may be at sub-atmospheric pressure, for example from about 14 psia (97 kPa) to about $1.9\times10^{-5}$ psia (0.13 Pa). Applying a layer of at least one metal to a substrate of unassembled reactor system component may require less reactor system downtime when compared to an otherwise identical method wherein the layer of metal is applied to an assembled like component of the reactor system.

Further disclosed herein is a method of treating a substrate, comprising applying a layer of at least one metal to the substrate to form an AML, followed by curing of the AML at a first temperature and first pressure for a first period of time, and curing the AML at a second temperature and second pressure for a second period of time, wherein the curing forms an MPL on the substrate. The MPL optionally may be further processed by mobilization and sequestration processes. The first temperature may be from about 600° F. (316° C.) to about 1,400° F. (760° C.) and the first pressure may be from about 215 psia (1,482 kPa) to about $1.9\times10^{-5}$ psia (0.13 Pa). The second temperature may be from about 600° F. (316° C.) to about 1,400° F. (760° C.) and the second pressure may be from about 215 psia (1,482 kPa) to about $1.9\times10^{-5}$ psia (0.13 Pa). The first pressure, second pressure, or both may be sub-atmospheric. The substrate may be an unassembled component of a structure and the AML may be cured to form an MPL prior to assembly of the unassembled treated component into the structure.

Further disclosed herein is a method of treating a substrate, comprising applying a layer of at least one metal to the substrate to form an AML on the substrate followed by curing of the AML at a temperature of greater than about 1,200° F. (649° C.) to form an MPL on the substrate wherein the AML comprises tin oxide, a decomposable tin compound and tin metal powder. The MPL optionally may be further processed by mobilization and sequestration processes. The applied metal layer may be cured at a temperature of from about 1,200° F. (649° C.) to about 1,400° F. (760° C.) and a pressure of from about sub-atmospheric pressure to about 315 psia (2,172 kPa). The metal protective layer may be bound to the substrate via a nickel-depleted bonding layer. The bonding layer may have a thickness of about 1 to about 100 μm. The metal protective layer may comprise stannide and may have a thickness of from about 0.25 μm to about 100 μm. The substrate may be an unassembled component of a structure and the applied metal layer is cured prior to the assembly of the unassembled component into the structure.

Further disclosed herein is a metal protective layer comprising a nickel-depleted bonding layer disposed between a substrate and the metal protective layer, wherein the metal protective layer is formed by applying a layer of at least one metal to the substrate to form an applied metal layer on the substrate and curing the applied metal layer form the metal protective layer on the substrate. The MPL optionally may be further processed by mobilization and sequestration processes. The applied metal layer may comprise tin oxide, a decomposable tin compound, and tin metal powder. The applied metal layer may be cured at a temperature of from about 1,220° F. (660° C.) to about 1,400° F. (760° C.) and/or at a pressure of from about 315 psia (2,172 kPa) to about 1 psia (0.05 Pa). The bonding layer may comprise stannide and may have a thickness of about 1 to about 100 μm. The bonding layer may comprise from about 1 wt % to about 20 wt % elemental tin. The substrate may be an unassembled component of a structure and the applied metal layer is cured prior to the assembly of the unassembled component into the structure.

Further disclosed herein is a hydrocarbon conversion system, comprising at least one furnace; at least one catalytic reactor; and at least one pipe connected between said at least one furnace and said at least one catalytic reactor for passing a gas stream containing a hydrocarbon from said at least one furnace to said at least one catalytic reactor. A substrate of at least one component of said hydrocarbon conversion system that is exposed to said hydrocarbon comprises an MPL prepared by a method comprising applying a layer of at least one metal to the substrate to form an AML and curing the AML to form an MPL prior to assembly of the component into the hydrocarbon conversion system.

The hydrocarbon conversion system may produce any number of petrochemical products. The hydrocarbon conversion system may nonoxidatively or oxidatively convert hydrocarbons to olefins and dienes. The hydrocarbon conversion system may dehydrogenate ethylbenzene to styrene, produce ethylbenzene from styrene and ethane, convert light hydrocarbons to aromatics, transalkylate toluene to benzene and xylenes, dealkylate alkylaromatics to less substituted alkylaromatics, produce fuels and chemicals from hydrogen and carbon monoxide, produce hydrogen and carbon monoxide from hydrocarbons, produce xylenes by the alkylation of toluene with methanol, or combinations thereof. In various embodiments, petrochemical products comprise without limitation, styrene, ethylbenzene, benzene, toluene, xylenes, hydrogen, carbon monoxide, and fuels. In some embodiments the petrochemical products comprise without limitation, benzene, toluene and xylenes.

The hydrocarbon conversion system may have austenitic stainless steel components that are subject to halide stress-corrosion cracking conditions. These components are provided with an MPL having improved halide stress corrosion cracking resistance. The component of the hydrocarbon conversion system may be a reactor wall, a furnace tube, a furnace liner, a reactor scallop, a reactor flow distributor, a center pipe, a cover plate, a heat exchanger, or combinations thereof. The reactor may be a catalytic reforming reactor and may further comprise a sulfur-sensitive, large-pore zeolite catalyst. The sulfur-sensitive, large-pore zeolite catalyst may comprise an alkali or an alkaline earth metal charged with at least one Group VIII metal. The substrate may be carburized, oxidized or sulfided and may be optionally cleaned prior to formation of the AML.

The AML may be formed by coating, plating, cladding or painting. Such coating, plating, cladding, or paint may comprise tin. For example, a coating may comprise a decomposable metal compound, a solvent system, a finely divided metal, and a metal oxide. The finely divided metal may have a particle size of from about 1 μm to about 20 μm.

The MPL provides resistance to carburization, metal dusting, halide stress corrosion cracking, and/or coking. The MPL may comprise a metal selected from the group consisting of copper, tin, antimony, germanium, bismuth, silicon, chromium, brass, lead, mercury, arsenic, indium, tellurium, selenium, thallium, copper, intermetallic compounds and alloys thereof, and combinations thereof. The MPL may comprise an intermediate nickel-depleted bonding layer in contact with the substrate, which anchors the layer to the substrate. The intermediate nickel-depleted bonding layer may contain stannide inclusions and may be formed by applying a layer of at least one metal to a substrate to form an AML on the substrate and curing the AML to form an MPL on the substrate.

The foregoing has outlined rather broadly the features and technical advantages of the present invention in order that the detailed description of the disclosure that follows may be better understood. Additional features and advantages that form the subject of the claims of this disclosure will be described hereinafter. It should be appreciated by those skilled in the art that the conception and the specific embodiments disclosed could be readily utilized as a basis for modifying or designing other structures for carrying out the same purposes of the present invention. It should also be realized by those skilled in the art that such equivalent constructions do not depart from the spirit and scope of this disclosure as set forth in the appended claims.

DETAILED DESCRIPTION OF THE PREFERRED EMBODIMENTS

Figure 1:
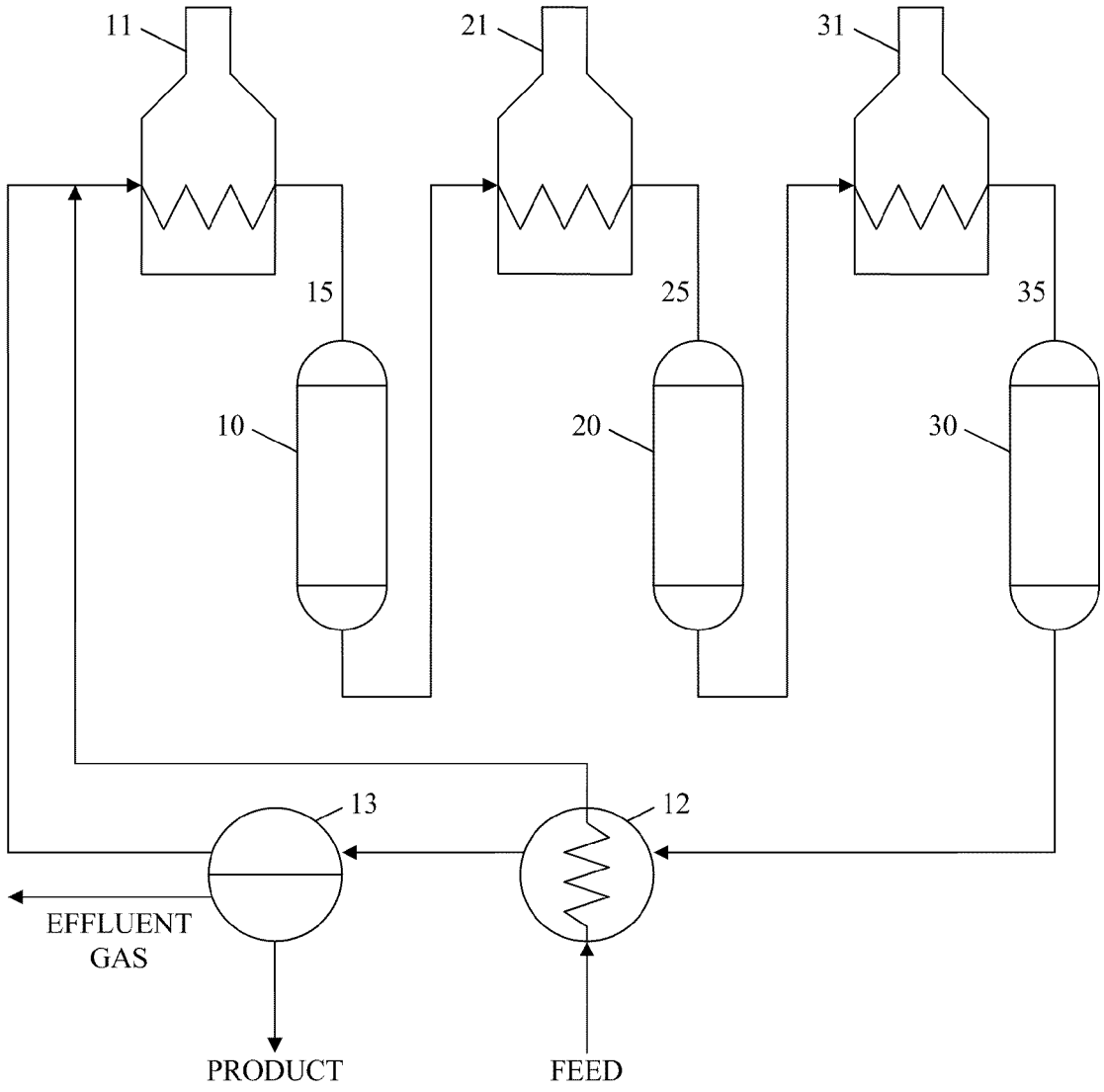
FIG. 1 is an illustration of a reforming reactor system.

In various embodiment, a protective material is applied to a substrate to form an AML, which may be subsequently cured to form an MPL for the substrate. As used herein, AML generally refers to the characteristics of the protective material prior to and/or after application thereof to a substrate, but prior to subsequent processing or chemical conversion, such as via reduction, curing, etc. As used herein, MPL generally refers to the characteristics of the protective material after such post-application processing or chemical conversion. In other words, AML generally refers to a precursor protective material whereas MPL generally refers to a final protective material. However, in certain instances details may be provided as to the AML that will also be applicable to the MPL, or vice-versa, as will be apparent to a person skilled in the art. For example, certain compounds present in the AML such as metals or metal compounds may also be present in or on the MPL, subject to any changes induced via the processing of the AML to the MPL. Such instances may be referred to herein by the term AML/MPL.

The AML/MPL may comprise one or more protective materials capable of rendering a substrate resistant to degradative processes such as halide stress corrosion cracking, coking, carburization and/or metal dusting. In an embodiment, there is formed a protective layer comprising the protective material anchored, adhered, or otherwise bonded to the substrate in an embodiment, the protective material may be a metal or combination of metals. In an embodiment, a suitable metal may be any metal or combination thereof resistant to forming carbides or coking under conditions of hydrocarbon conversion such as catalytic reforming. Examples of suitable metals or metal compounds include without limitation compounds of tin such as stannides; antimony such as antimonides; bismuth such as bismuthides; silicon; lead; mercury; arsenic; germanium; indium; tellurium; selenium; thallium; copper; chromium; brass; intermetallic alloys; or combinations thereof. While not wishing to be bound by theory, it is believed that the suitability of various metal compounds in the AML/MPL may be selected and classified according to their resistance to carburization, halide stress corrosion cracking, metal dusting, coking and/or other degradation mechanisms.

The AML may be formulated to allow the protective materials to be deposited, plated, cladded, coated, painted or otherwise applied onto the substrate. In an embodiment, the AML comprises a coating, which further comprises a metal or combination of metals suspended or dissolved in a suitable solvent. A solvent as defined herein is a substance, usually but not limited to a liquid, capable of dissolving or suspending another substance The solvent may comprise a liquid or solid that may be chemically compatible with the other components of the AML. An effective amount of solvent may be added to the solid components to render the viscosity such that the AML is sprayable and/or spreadable. Suitable solvents include without limitation alcohols, alkanes, ketones, esters, dibasic esters, or combinations thereof. The solvent may be methanol, ethanol, 1-propanol, 1-butanol, 1-pentanol, 2-methyl-1-propanol, neopentyl alcohol, isopropyl alcohol, propanol, 2-butanol, butanediols, pentane, hexane, cyclohexane, heptane, methylethyl ketone, any combination thereof, or any other solvent described herein.

The AML may further comprise an effective amount of additives for improving or changing the properties thereof, including without limitation thickening, binding or dispersing agents. In an embodiment, the thickening, binding or dispersing agents may be a single compound. Without wishing to be limited by theory, thickening, binding or dispersing agents may modify the Theological properties of the AML such that the components thereof are dispersed in the solvent and maintain a stable viscosity by resisting sedimentation. Addition of a thickening, binding or dispersing agent may also allow the AML to become dry to the touch when applied on a substrate and resist running or pooling. Suitable thickening, binding or dispersing agents are known to one of ordinary skill in the art. In an embodiment, the thickening, binding or dispersing agent is a metal oxide.

In an embodiment, the AML may be a metal coating comprising an effective amount of a hydrogen decomposable metal compound, a finely divided metal, and a solvent. The hydrogen decomposable metal compound may be any organometallic compound that decomposes to a smooth metallic layer in the presence of hydrogen. In some embodiments the hydrogen decomposable metal compound comprises organotin compounds, organoantimony compounds, organobismuth compounds, organosilicon compounds, organolead compounds, organoarsenic compounds, organogermanium compounds, organoindium compounds, organtellurium compounds, organoselenium compounds, organocopper compounds, organochromium compounds, or combinations thereof. In an alternative embodiment, the hydrogen decomposable metal compound comprises at least one organometallic compound such as $MR^1R^2R^3R^4$, where M is tin, antimony, bismuth, silicon, lead, arsenic, germanium, indium, tellurium, selenium, copper, or chromium and where each $R^{1-4}$ is a methyl, ethyl, propyl, butyl, pentyl, hexyl, halides, or mixtures thereof. In a further embodiment, the hydrogen decomposable metal compound comprises a metal salt of an organic acid anion containing from 1 to 15 carbon atoms, wherein the metal may be tin, antimony, bismuth, silicon, lead, arsenic, germanium, indium, tellurium, selenium, copper, chromium or mixtures thereof The organic acid anion may be acetate, propionate, isopropionate, butyrate, isobutyrates, pentanoate, isopentanoate, hexanoate, heptanoate, octanoate, nonanoate, decanoate oxyolate, neodecanoate, undecanoate, dodecanoate, tredecanoate, tetradecanoate, dodecanoate or combinations thereof The finely divided metal may be added to the AML to ensure the presence of reduced metal capable of reacting with the substrate even under conditions where the formation of reduced metal is disfavored such as low temperatures or a non-reducing atmosphere. In an embodiment, the finely divided metal may have a particle size of from about 1 μm to about 20 μm. Without wishing to be limited by theory, metal of this particle size may facilitate uniform coverage of the substrate by the AML.

In an embodiment, the aforementioned AML may be a tin-containing coating comprising at least four ingredients (or their functional equivalents): (i) a hydrogen decomposable tin compound, (ii) a solvent system (as described previously), (iii) a finely divided tin metal and (iv) tin oxide as a reducible thickening, binding or dispersing agent. The coating may comprise finely divided solids to minimize settling.

Ingredient (i), the hydrogen decomposable tin compound, may be an organotin compound. The hydrogen decomposable tin compound may comprise tin octanoate or neodecanoate. These compounds will partially dry to a gummy consistency on the substrate that is resistant to cracking and/or splitting, which is useful when a coated substrate is handled or stored prior to curing. Tin octanoate or neodecanoate will decompose smoothly to a tin layer which forms iron stannide in hydrogen at temperatures from as low as about 600° F. (316° C.). In an embodiment, the tin octanoate or neodecanoate may farther comprise less than or equal to about 5 wt %, alternatively less than or equal to about 15 wt %, alternatively less than or equal to about 25 wt %, of the respective octanoic acid or neodecanoic acid. Tin octanoate has been given Registry Number 4288-15-7 by Chemical Abstracts Service. Tin neodecanoate has been given Registry Number 49556-16-3 by Chemical Abstracts Service.

Finely divided tin metal, ingredient (iii), may be added to insure that reduced tin is available to react with the substrate even under conditions where the formation of reduced metal may be disfavored such as at low temperatures or under non-reducing conditions. The particle size of the finely divided tin metal may be from about 1 μm to about 20 μm which allows excellent coverage of the substrate surface to be coated with tin metal. Non-reducing conditions may be conditions with low amounts of reducing agent or low temperatures. The presence of reduced tin ensures that even when part of the coating cannot be completely reduced, tin metal will be present to react and form the desired MPL layer. Without wishing to be limited by theory, metal of this particle size may facilitate uniform coverage of the substrate by the AML.

Ingredient (iv), the tin oxide thickening, binding or dispersing agent, may be a porous tin-containing compound which can absorb an organometallic tin compound, yet still be reduced to active tin in a reducing atmosphere. The particle size of the tin oxide may be adjusted by any means known to one of ordinary skill in the art. For example, the tin oxide may be processed through a colloid mill to produce very fine particles that resist rapid settling. Addition of tin oxide may provide an AML that becomes dry to the touch, and resists running. In an embodiment, ingredient (iv) is selected such that it becomes an integral part of the MPL when reduced.

In one embodiment, an AML may be a coating comprising less than or equal to about 65 wt %, alternatively less than or equal to about 50 wt %, alternatively from about 1 wt % to about 45 wt % hydrogen decomposable metal compound; in addition to the metal oxide; metal powder and isopropyl alcohol. In a flrther embodiment, an AML may be a tin coating comprising up to about 65 wt %, alternatively up to about 50 wt %, alternatively from about 1 wt % to about 45 wt % hydrogen decomposable tin compound; in addition to the tin oxide; tin powder; and isopropyl alcohol.

The AML/MPL of this disclosure may be used on any substrate to which it adheres, clings, or binds, and provides protection from degradative processes. In an embodiment, any system comprised of a coking-sensitive, carburization-sensitive, halide stress-corrosion cracking sensitive and/or metal-dusting sensitive material may serve as a substrate for the AML/MPL. In a further embodiment, the substrate may comprise carbon steel, mild steel, alloy steel, stainless steel, austenitic stainless steel, or combinations thereof Examples of systems that may serve as substrates for the AML/MPL include without limitation systems such as hydrocarbon conversion systems, refining systems such as hydrocarbon refining systems, hydrocarbon reforming systems, or combinations thereof. The term "reactor system" as used herein includes one or more reactors containing at least one catalyst and its corresponding furnace, heat exchangers, piping, etc. Examples of reactor system components that may serve as substrates include heat exchangers; furnace internals such as interior walls, furnace tubes, furnace liners, etc.; and reactor internals such as interior reactor walls, flow distributors, risers, scallops, center pipes in a radial flow catalytic reactor, etc. In an embodiment, the substrate may be a component of a hydrocarbon conversion reactor system. In an alternative embodiment, the substrate may be a component of a catalytic reformer.

In an embodiment, the substrate may be a surface of a component in a catalytic reforming reactor system such as that shown in FIG. 1. The reforming reactor system may include a plurality of catalytic reforming reactors (10), (20) and (30). Each reactor contains a catalyst bed. The system also includes a plurality of furnaces (11), (21) and (31); heat exchanger (12); separator (13); a plurality of pipes (15), (25), and (35) connecting the furnaces to the reactors; and additional piping connecting the remainder of the components as shown in FIG. 1. It will be appreciated that this disclosure is useful in continuous catalytic reformers utilizing moving beds, as well as fixed bed systems. Catalytic reforming systems are described in more detail herein and in the various patents incorporated by reference herein.

In an embodiment, the substrate may be a surface of a hydrocarbon conversion system (HCS) or a component thereof used for manufacturing any number of petrochemical products. The hydrocarbon conversion system may function to oxidatively convert hydrocarbons to olefins and dienes. Alternatively, the hydrocarbon conversion system may function to nonoxidatively convert hydrocarbons to olefins and dienes. Alternatively, the hydrocarbon conversion system may function to carry out any number of hydrocarbon conversion system reactions. In various embodiments, hydrocarbon conversion system reactions comprise without limitations the dehydrogenation of ethylbenzene to styrene, the production of ethylbenzene from styrene and ethane, the transalkylation of toluene to benzene and xylenes, the dealkylation of alkylaromatics to less substituted alkylaromatics, the production of fuels and chemicals from hydrogen and carbon monoxide, the production of hydrogen and carbon monoxide from hydrocarbons, the production of xylenes by the alkylation of toluene with methanol, the conversion of light hydrocarbons to aromatics, or removal of sulfur from motor gasoline products. In various embodiments, petrochemical products comprise without limitation, styrene, ethylbenzene, benzene, toluene, xylenes, hydrogen, carbon monoxide, and fuels. In some embodiments the petrochemical products comprise without limitation, benzene, toluene and xylenes.

In another embodiment, the substrate may be a surface of a refining system or a component thereof. As used herein refining systems includes processes for the enrichment of a particular constituent of a mixture trough any known methodology. One such methodology may comprise catalytic conversion of at least a portion of a reactant to the desired product. An alternative methodology may involve the separation of a mixture into one or more constituents. The extent of separation may be dependent on the design of the refining system, the compounds to be separated and the separation conditions. Such refining systems and enrichment conditions are known to one skilled in the art.

Substrates may have a base metallurgy comprising halide stress corrosion cracking-sensitive, carburization-sensitive, coking-sensitive and/or metal-dusting sensitive compounds such as nickel, iron, or chromium. In an embodiment, a suitable base metallurgy may be any metallurgy containing a sufficient quantity of iron, nickel, chromium, or any other suitably reactive metal to react with the metal in the AML and form a uniform layer. In an embodiment, a suitable base metallurgy may be any metallurgy containing a sufficient quantity of iron, nickel, or chromium to react with tin and form a stannide layer. Without limitation suitable base metallurgies comprise 300 and 400 series stainless steel.

The metallurgical terms used herein are to be given their common metallurgical meanings as set forth in THE METALS HANDBOOK of the American Society of Metals, incorporated herein by reference. As used herein, "carbon steels" are those steels having no specified minimum quantity for any alloying element (other than the commonly accepted amounts of manganese, silicon and copper) and containing only an incidental amount of any element other than carbon, silicon, manganese, copper, sulfur and phosphorus. As used herein, "mild steels" are those carbon steels with a maximum of about 0.25 wt % carbon. As used herein, "alloy steels" are those steels containing specified quantities of alloying elements (other than carbon and the commonly accepted amounts of manganese, copper, silicon, sulfur and phosphorus) within the limits recognized for constructional alloy steels, added to effect changes in mechanical or physical properties. Alloy steels will contain less than about 10 wt % chromium. As used herein, "stainless steels" are any of several steels containing at least about 10 wt %, alternatively about 12 wt % to about 30 wt %, chromium as the principal alloying element. As used herein, "austenitic stainless steels" are those having an austenitic nmcrostructure. These steels are known in the art. Examples include 300 series stainless steels such as 304 and 310, 316, 321, 347. Austenitic stainless steels typically contain between about 16 wt % and about 20 wt % chromium and between about 8 wt % and about 15 wt % nickel. Steels with less than about 5 wt % nickel are less susceptible to halide stress corrosion cracking. Suitable substrates may comprise one or more of the foregoing metallurgies.

The AML may be plated, painted, cladded, coated or otherwise applied to the substrate. In an embodiment, the AML is formulated to be applied as a coating. Suitable methods of applying the AML to the substrate as a coating include without limitation spraying, brushing, rolling, pigging, dipping, soaking, pickling, or combinations thereof. Devices for applying the AML to the substrate are known to one of ordinary skill in the art. The AML may be applied as a wet coating with a thickness of from about 1 mil (25 μm) to about 100 mils (2.5 mm), alternatively of from about 2 mils (51 μm) to about 50 mils (1.3 mm) per layer. Multiple applications (e.g., multiple coats) of the AML may be utilized as needed to impart to the substrate the physical properties and protection desired. The AML may have viscosity characteristics sufficient to provide a substantially continuous coating of measurable and substantially controllable thickness.

An AML applied to the substrate, such as a reactor system component, as a wet coating may dry by evaporation of the solvent or other carrier liquid to form a dry coating that may be suitable for handling. In some embodiments, the AML may have a tacky or gummy consistency that is resistant to cracking when a coated substrate is handled or stored before curing. In an embodiment, the AML may dry about instantaneously upon contacting the substrate; alternatively, the AML may dry in less than about 48 hours from the time the AML contacts the substrate. In some embodiments, a drying device may be used to facilitate removal of the solvent to form a dry coating, such as forced air or other drying means. Suitable drying devices are known to one skilled in the art.

An AML applied to a substrate as a wet coating may be further processed in addition to, in lieu of, or in conjunction with drying to provide an MPL that is resistant to the degradative processes described previously. Examples of further processing of the AML to form the MPL include but are not limited to curing and/or reducing. In an embodiment, the AML may be applied to a substrate as a coating that dries to form a coating, which may be further cured and/or reduced to form the MPL.

In an embodiment, the coating may be sprayed onto or into reactor system components. Sufficient amounts of the coating should be applied to provide a continuous coating of the substrate of the reactor system component. After a component is sprayed, it may be left to dry for about 24 hours and may be further processed by application of a slow stream of gas. In various embodiments the gas may be an inert gas, an oxygen containing gas, or combinations thereof. Non-limiting examples of gases include air, nitrogen, helium, argon, or combinations thereof The gas may be heated. In an embodiment, the gas may be nitrogen at about 150° F. (66° C.) and may be applied for about 24 hours. Thereafter, a second coating layer may be applied to the reactor system component and may be dried by the procedure described above. After the AML has been applied, the AML on the reactor system component may be protected from oxidation by the introduction of a nitrogen atmosphere and should be protected from exposure to water using methods known to one of skill in the art.

The methodologies disclosed herein may also be used for retrofitting or repairing previously carburized, sulfided or oxidized systems for use in low-sulfur, and low-sulfur and low-water processes. In an embodiment, a previously carburized substrate surface may be treated with an AML/MPL comprising one or more of the protective materials described herein. In another embodiment, a sulfided or oxidized substrate of a reactor system component may be treated with an AML/MPL comprising one or more of the protective materials described herein.

During retrofitting or repairing processes, coke, oxidized substrate, or sulfided substrate may be removed from the surface of the reactor system component prior to application of the AML, as it may interfere with the reaction between the AML and the substrate. A number of cleaning techniques are possible including (i) oxidizing the substrate surface, (ii) oxidizing the substrate surface and chemically cleaning, (iii) oxidizing the substrate surface and chemically cleaning followed by passivation, (iv) oxidizing the substrate surface and physically cleaning and (v) hydroblasting the substrate surface. Technique (i) may be useful to remove residual coke and would be acceptable if the oxide or sulfide layer is thin enough to allow an MPL to form properly. Alternatively, techniques (ii)-(v) may be used to more thoroughly remove the oxide or sulfide layer to prevent interference with the formation of an MPL. Combinations of the aforementioned cleaning techniques in a particular plant, or for a particular system, may be used. Ultimately a number of factors unique to the particular plant or system, such as reactor geometry, may influence the choice.

An AML may be applied to the substrate of an assembled or unassembled component of a structure such as a reactor system. Likewise, the AML may be cured or processed as described in this disclosure prior to, during, or after assembly or disassembly of the structure. In an embodiment, a reactor component may be disassembled from an existing reactor, optionally cleaned, coated and processed as described in this disclosure prior to reassembly of the component into the reactor system. Alternatively, a new reactor component or a replacement component may be coated and processed as described herein prior to incorporation of the component into an assembled system. In this way, an existing reactor structure having some portion without a protective layer may have an AML applied to new or replacement components thereof, thus avoiding unnecessary exposure of previously coated components to curing conditions.

In an embodiment, a substrate having been previously treated with a protective layer may have an MPL reapplied to improve the substrate's resistance to degradative processes. In a further embodiment, a previously treated reactor or component thereof having experienced some degree of wear may have its resistance to degradative processes increased by optional cleaning and reapplication of an AML to the reactor or components thereof followed by curing and processing as described in this disclosure.

The substrate may be heated after application of the AML to cure same. Curing the AML may result in the metal of the AML reacting and bonding with the substrate to form a continuous MPL that is resistant to degradative processes such as halide stress corrosion cracking, metal dusting, coking and/or carburization. In an embodiment, an AML comprising a hydrogen decomposable compound (such as tin octanoate), a finely divided metal (such as tin) and a metal oxide (such as tin oxide) may be applied and cured to produce an intermetallic MPL bonded to the substrate through an intermediate bonding layer, such as a nickel-depleted bonding layer. The characteristics of an intermediate nickel-depleted bonding layer will be discussed further herein.

When the AML is applied at the above-described thickness, initial reduction conditions will result in metal migrating to cover small regions that were not originally coated. This may completely coat the substrate. In the case of tin, stannide layers such as iron and nickel stannides are formed.

In an embodiment, the AML may be cured at any temperature and pressure compatible with maintaining the structural integrity of the substrate. In an alternative embodiment, the AML may be cured at sufficient temperatures and pressures and for sufficient time periods to maximize formation of an MPL while minimizing the time for which a substrate is unavailable for normal operation or further use.

In an embodiment, the AML may be cured at a temperature of from about 600° F. (316° C.) to about 1,400° F. (760° C.), alternatively of from about 650° F. (343° C.) to about 1,350° F. (732° C.), alternatively of from about 700° F. (371° C.) to about 1,300° F. (704° C.). In a further embodiment, an AML comprising tin may be cured at a temperature of from about 600° F. (316° C.) to about 1,400° F. (760° C.), alternatively of from about 650° F. (343° C.) to about 1,350° F. (732° C.), alternatively of from about 700° F. (371° C.) to about 1,300° F. (704° C.). The heating may be carried out for a period of time of from about 1 hour to about 150 hours, alternatively from about 5 hours to about 130 hours, alternatively from about 10 hours to about 120 hours.

In an embodiment, the AML may be cured at or above atmospheric pressure in a range of from about atmospheric pressure to about 215 psia (1,482 kPa), alternatively from about 20 psia (138 kPa) to about 165 psia (1,138 kPa), alternatively from about 25 psia (172 kPa) to about 115 psia (793 kPa).

In an embodiment, the AML may be cured at sub-atmospheric pressures. Without wishing to be limited by theory, curing the AML at sub-atmospheric pressures may allow for the use of elevated temperatures that promote the rapid and nearly complete conversion of the AML to the MPL. This reaction may result in a uniform MPL of sufficient thickness to render the substrate resistant to degradative processes. The curing may be performed at sub-atmospheric pressures of from about atmospheric pressure to about $1.9\times10^{-5}$ psia (0.13 Pa), alternatively of from about 14 psia (97 kPa) to about $1.9\times10^{-4}$ psia (1.3 Pa), alternatively of from about 10 psia (69 kPa) to about $1.9\times10^{-3}$ psia (13 Pa). Under these conditions, formation of an MPL having the desired properties may occur in a period of from about 1 hour to about 150 hours.

In an embodiment, a substrate having been coated with an AML may be cured via a two-step process comprising heating the coated substrate for a first period of time at a first temperature and pressure followed by heating at a second period of time at a second temperature and pressure, wherein the second temperature, pressure, or both is different than the first temperature, pressure, or both. Without wishing to be limited by theory a second heating of the coated substrate may serve to reduce the amount of unreacted AML metal remaining after the first heating.

In an embodiment, an AML comprising tin oxide; a decomposable tin compound; and tin metal powder may be cured at high temperatures at pressures from about $1.9\times10^{-5}$ psia (0.13 Pa) to about 315 psia (2,172 kPa). In a further embodiment the temperature may be equal to or greater than about 1,200° F. (649° C.), alternatively from about 1,200° F. (649° C.) to about 1,400° F. (760° C.), alternatively from about 1,300° F. (704° C.) to about 1,400° F. (760° C.). The curing may be performed at any of the previously described pressures, such as about 315 psia (2,172 kPa) to about to about $1.9\times10^{-5}$ psia (0.13 Pa) or 215 psia (1,482 kPa) to about $1.9\times10^{-5}$ psia (0.13 Pa).

In an embodiment, the coated substrate may be heated at a first temperature, and pressure, for a period of time as described previously. Following the first heating, the coated substrate may be heated at a second temperature about greater than, equal to, or less than the first temperature. The second heating may be performed at temperatures of from about 600° F. (316° C.) to about 1,400° F. (760° C.), alternatively of from about 650° F. (343° C.) to about 1,350° F. (732° C.), alternatively of from about 700° F. (371° C.) to about 1,300° F. (704° C.). In an embodiment, the second heating may be carried out at a second pressure about greater than, equal to, or less than the first pressure. The second heating may be performed at pressures of from about $1.9\times10^{-5}$ psia (0.13 Pa) to about 215 psia (1,480 kPa), alternatively of from about $1.9\times10^{-4}$ psia (1.3 Pa) to about 165 psia (1,140 kPa), alternatively of from about $1.9\times10^{-3}$ psia (13 Pa) to about 115 psia (793 kPa). The second heating may be carried out for a period of time of from about 1 hour to about 120 hours.

In an embodiment, the AML may be cured under reducing conditions. Curing the AML under reducing conditions may facilitate conversion of the AML to an MPL. Suitable reducing agents depend on the metal in the AML and are known to one of ordinary skill in the art.

In an embodiment, an AML comprising tin compounds may be cured in the presence of a reducing gas. The reducing gas may be hydrogen, carbon monoxide, hydrocarbons or combinations thereof. In a further embodiment, the hydrogen, carbon monoxide or hydrocarbons may be blended with a second gas. The second gas may be argon, helium, nitrogen, any inert gas or combinations thereof The volume % of the reducing gas may be about 100 vol %, alternatively about 90 vol %, alternatively about 80 vol %, alternatively about 75 vol %, alternatively about 50 vol %, alternatively about 25 vol % with the balance made up with the second gas or a combination of the second gases.

In an embodiment, the AML may be treated under reducing conditions with hydrogen, which may be in the presence or absence of hydrocarbons. In an embodiment, the AML may be cured in the presence of about 80 volume % of hydrogen and about 20 volume % of nitrogen. In a fiirther embodiment, the AML may be cured in the presence of about 75 volume % of hydrogen and about 25 volume % of nitrogen.

In an embodiment, a substrate may be optionally cleaned, the AML may be applied to the substrate, the AML may be cured or fiurher processed to form the MPL, or combinations thereof at any suitable location and by any device or means capable of achieving the desired temperatures, pressures, and operating environment (such as a reducing atmosphere) for the desired time period. In an embodiment, the AML coated on the substrate may be cured in a vacuum oven operating under the previously disclosed conditions.

A substrate may be optionally cleaned, coated, and processed as described in this disclosure at any convenient site. In an embodiment, the optional cleaning and coating of the substrate, and/or curing of the AML may be carried out at the reactor operation site, distal to the reactor operation site or proximal to the reactor operation site. In an embodiment, the substrate may be optionally cleaned and coated and/or the AML may be cured at a location other than the reactor operation site and/or ex situ the reactor system. In an embodiment, a reactor component may be transported to, a cleaning, coating or curing facility from a component manufacturing facility. Alternatively, a reactor component may be optionally cleaned and coated, and/or the AML may be cured at a manufacturing facility and subsequently transported to a final assembly location. Alternatively, a component of an existing reactor system may be disassembled, optionally cleaned and coated followed by curing of the AML. The disassembled component may have an AML applied on site and subsequently transported to a curing facility such as a large scale commercial oven. Alternatively, the disassembled component may be transported and subsequently optionally cleaned and coated, and/or the AML may be cured at an off-site facility.

A substrate having an MPL may be fierier processed to remove any quantity of reactive metals from the surface of the substrate. In an embodiment this process comprises contacting the MPL with a mobilization agent followed by a sequestration process to trap a mobile metal. Without wishing to be limited by theory, treatment of the reactive metals with a mobilization agent may convert the metals to more reactive or more mobile forms and thus facilitate removal by sequestration processes.

The term "sequestration" as used herein means to purposely trap the metals or metal compounds produced from the reactive metals by the mobilization agent to facilitate removal. Sequestration also refers to sorbing, reacting or otherwise trapping the mobilization agent. The terms "movable metals" or "movable tin" as used refer to the reactive metals after reaction with the mobilization agent. Generally, it is the movable metals and the mobilization agent that are sequestered. As used herein, the term "reactive metals," such as "reactive tin," is intended to include elemental metals or metal compounds that are present in or on MPL layers which may be mobilized under process conditions. The term "reactive metals" as used herein comprises metal compounds described herein that will migrate at temperatures from about 200° F. (93° C.) to about 1,400° F. (760° C.) when contacted with a mobilization agent, and which would thereby result in catalyst deactivation or equipment damage during operation of the reactor system.

In an embodiment, reactive tin is mobilized under process conditions that comprise between about 0.1 parts per million by weight (ppm) to about 100 ppm HCl. For instance, reactive tin may be mobilized when halogen-containing catalysts, which can evolve chlorine, are used for catalytic reforming in a freshly tin-coated reactor system having freshly-prepared MPL layers. When used in the context of reforming, the term "reactive tin" comprises any one of elemental tin, tin compounds, tin intermetallics, tin alloys, or combinations thereof that will migrate at temperatures from about 200° F. (93° C.) to about 1,400° F. (760° C.) when contacted with a mobilization agent, and which would thereby result in catalyst deactivation during reforming operations or during heating of the reformer furnace tubes. In other contexts, the presence of reactive metals will depend on the particular metals, the mobilization agent, as well as the reactor process and its operating conditions.

Sequestration may be done using chemical or physical treating steps or processes. The sequestered metals and mobilization agent may be concentrated, recovered, or removed from the reactor system. In an embodiment, the movable metals and mobilization agent may be sequestered by contacting it with an adsorbent, by reacting it with compound that will trap the movable metals and mobilization agent, or by dissolution, such as by washing the reactor system substrate surfaces with a solvent and removing the dissolved movable metals and mobilization agent.

The choice of sorbent depends on the particular form of the mobile metals and its reactivity for the particular mobile metals. In an embodiment, the sorbent may be a solid or liquid material (an adsorbent or absorbent) which will trap the mobile metals. Suitable liquid sorbents include water, liquid metals such as tin metal, caustic, and other basic scrubbing solutions. Solid sorbents effectively trap the movable metals and mobilization agent by adsorption or by reaction. Solid sorbents are generally easy to use and subsequently easy to remove from the system. A solid sorbent may have a high surface area (such as greater than about 10 $m^2/g$), have a high coefficient of adsorption with the movable metals and mobilization agent or react with the movable metals and mobilization agent to trap same. A solid sorbent retains its physical integrity during this process such that the sorbent maintains an acceptable crush strength, attrition resistance, etc. The sorbents can also include metal tunings, such as iron turnings that will react with movable tin chloride. In an embodiment, the sorbents may be aluminas, clays, silicas, silica aluminas, activated carbon, zeolites or combinations thereof In an alternative embodiment, the sorbent may be a basic alumina, such as potassium on alumina, or calcium on alumina.

In an embodiment, the mobilization agent may be a halogen-containing compound. As used herein, the term "halogen-containing compound" or "halogen-containing gas" includes, but is not limited to, elemental halogen, acid halides, alkyl halides, aromatic halides, other organic halides including those containing oxygen and nitrogen, inorganic halide salts and halocarbons or mixtures thereof Water may optionally be present. In an embodiment, a gas comprising HCl may be used as the mobilization agent. Then, effluent HCl, residual halogen-containing gas (if present) and movable metals, are all sequestered. The halogen-containing compounds may be present in an amount of from about 0.1 ppm to about 1,000 ppm, alternatively of from about 1 ppm to about 500 ppm, alternatively of from about 10 ppm to about 200 ppm.

In an embodiment, the MPL is exposed to a mobilization agent at a temperature of from about 200° F. (93° C.) to about 1,000° F. (538° C.), alternatively of from about 250° F. (121° C.) to about 950° F. (510° C.), alternatively of from about 300° F. (149° C.) to about 900° F. (482° C.) for a period of from about 1 hours to about 200 hours. Sequestration and other processes for removal of reactive metals in or on the MPL are disclosed in U.S. Pat. Nos. 6,551,660 and 6,419,986, incorporated by reference herein.

In an embodiment, an MPL may be used to isolate the substrate of a reactor or reactor component from hydrocarbons. An MPL formed by the disclosed methodologies may display a high degree of homogeneity with a thickness sufficient to render the substrate resistant to the degradative processes previously described.

Figure 2:
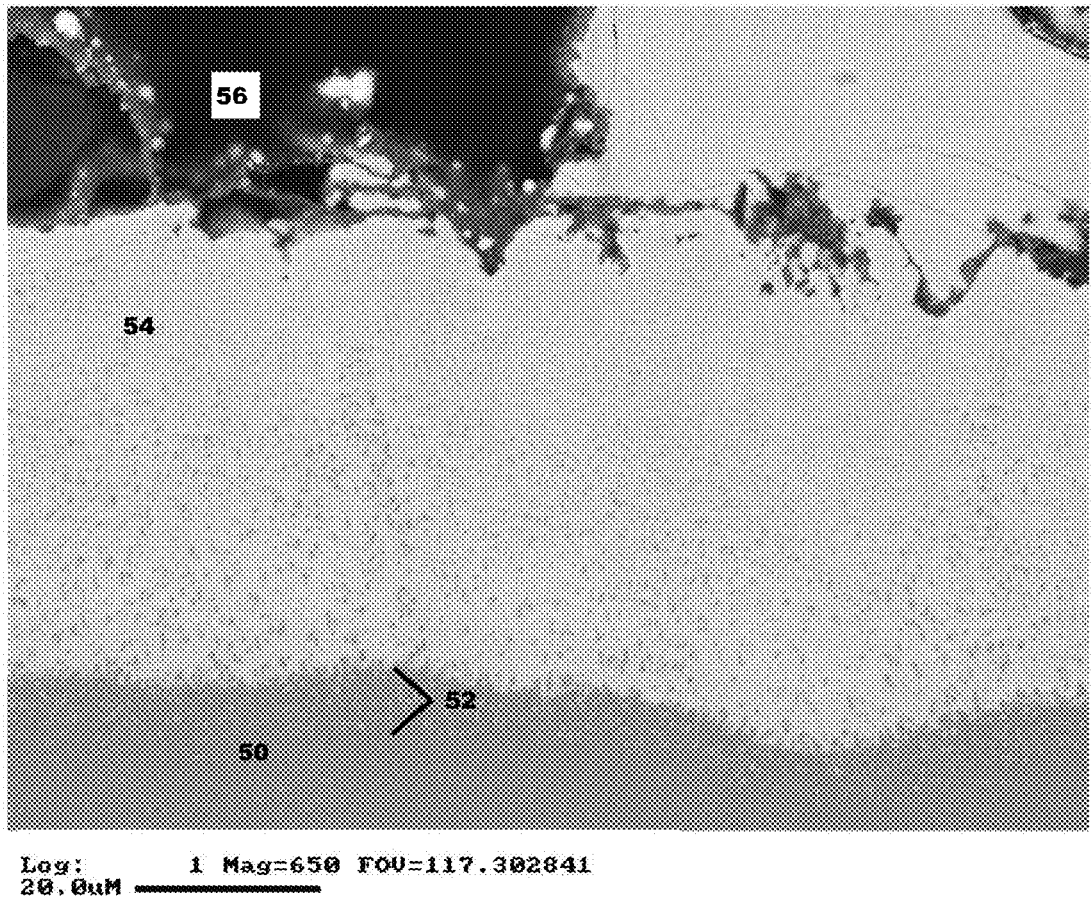
FIG. 2 is a backscatter SEM image of the MPL produced in Example 10.

The MPL layer can comprise an intermediate nickel-depleted bonding layer that anchors the MPL to the substrate. In an embodiment, the MPL comprises a stannide layer with the bonding layer disposed between the stannide layer and the substrate. The stannide layer may be nickel-enriched and comprise carbide inclusions, while the intermediate nickel-depleted bonding layer may comprise stannide inclusions, as is shown in FIG. 2. The nickel-enriched stannide layer is "enriched" in comparison to the -nickel-depleted bonding layer. Additionally, the nickel-enriched stannide layer may comprise carbide inclusions which may be isolated or may be continuous extensions or projections of the intermediate nickel-depleted bonding layer as they extend, substantially without interruption, from said bonding layer into said stannide layer, and the stannide inclusions may likewise comprise continuous extensions of nickel-enriched stannide layer into the intermediate nickel-depleted bonding layer. The interface between the intermediate nickel-depleted bonding layer and the nickel-enriched stannide layer may be irregular, but otherwise substantially without interruption. The extent to which the aforementioned phases, layers and inclusions develop may be a function of the reducing conditions and temperature at which the AML is treated, and the amount of time at which exposure is maintained.

In further embodiments, the intermediate nickel-depleted bonding layer comprising stannide inclusions comprises from about 0.5 wt % to about 20 wt %; alternatively from about 1 wt % to about 17 wt %; alternatively from about 1.5 wt % to about 14 wt % of elemental tin. While not wishing to be bound by theory.it is believed that formation of the intermediate nickel-depleted bonding layer comprising stannide inclusions is controlled by curing temperatures and pressures, particularly conditions that combine high temperatures and low pressures. In some embodiments the temperatures necessary to generate an intermediate nickel-depleted bonding layer comprising stannide inclusions comprises temperatures of about 1,220° F. to about 1,400° F. (760° C.) and pressures of 315 psia (2,172 kPa) to about to about 1 psia (0.05 Pa).

In an embodiment, the MPL comprises a stannide layer bonded to a metal substrate (e.g., steel) via an intermediate nickel-depleted bonding layer comprising stannide inclusions. The MPL may have a total thickness of from about 1 μm to about 150 μm, alternatively of from about 1 μm to about 100 μm, alternatively of from about 1 μm to about 50 μm. The stannide layer may have a thickness of from about 0.25 μm to about 100 μm, alternatively of from about 0.5 μm to about 75 μm, alternatively of from about 1 μm to about 50 μm. The intermediate nickel-depleted bonding layer comprising stannide inclusions has a thickness of from about 1 to about 100 μm; alternatively from about 1 to about 50 μm; alternatively from about 1 to about 10 μm.

In an embodiment, an AML/MPL may be applied to the substrate surface of a component of a catalytic reforming system for reforming light hydrocarbons such as naphtha to cyclic and/or aromatic hydrocarbons. The naphtha feed may be hydrocarbons with a boiling range of from about 70° F. (21° C.) to about 450° F. (232° C.). In an embodiment, additional feed processing occurs to produce a feed that is substantially free of sulfur, nitrogen, metals, and other known catalyst poisons. These catalyst poisons may be removed by first using hydrotreating techniques, and then using sorbents to remove the remaining sulfur compounds.

While catalytic reforming typically refers to the conversion of naphtha to aromatics, other feedstocks may be treated as well to provide an aromatics enriched product. Therefore, while the conversion of naphtha is one embodiment, catalytic reformers may be useful for the conversion or aromatization of a variety of feedstocks such as saturated hydrocarbons, paraffinic hydrocarbons, branched hydrocarbons, olefinic hydrocarbons, acetylenic hydrocarbons, cyclic hydrocarbons, cyclic olefinic hydrocarbons, mixtures thereof and other feedstocks as known to one of ordinary skill in the art.

Examples of light hydrocarbons include without limitation those having 6 to 10 carbons such as n-hexane, methylpentane, n-heptane, metylhexane, dimethylpentane and n-octane. Examples of acetylene hydrocarbons include without limitation those having 6 to 10 carbon atoms such as hexyne, heptyne and octyne. Examples of acyclic paraffin hydrocarbons include without limitation those having 6 to 10 carbon atoms such as methylcyclopentane, cyclohexane, methylcyclohexane and dinethylcyclohexane. Typical examples of cyclic olefin hydrocarbons include without limitation those having 6 to 10 carbon atoms such as methylcyclopentene, cyclohexene, methylcyclohexene, and dimethylcyclohexene.

Some of the other hydrocarbon reactions that occur during the reforming operation include the dehydrogenation of cyclohexanes to aromatics, dehydroisomerization of alkylcyclopentanes to aromatics, and dehydrocyclization of acyclic hydrocarbons to aromatics. A number of other reactions also occur, including the dealkylation of alkylbenzenes, isomerization of paraffins, and hydrocracking reactions, which produce light gaseous hydrocarbons such as, methane, ethane, propane and butane. Thus, "reforming" as used herein refers to the treatment of a hydrocarbon feed through the use of one or more aromatics producing reactions in order to provide an aromatics enriched product (i.e., a product whose aromatics content is greater than in the feed).

Operating ranges for a typical reforming process include reactor inlet temperatures of from about 700° F. (371° C.) to about 1,300° F. (704° C.); a system pressure of from about 30 psia (207 kPa) to about 415 psia (2,860 kPa); a recycle hydrogen rate sufficient to yield a hydrogen to hydrocarbon mole ratio for the feed to the reforming reactor zone of from about 0.1 to about 20; and a liquid hourly space velocity for the hydrocarbon feed over the reforming catalyst of from about 0.1 $hr^{-1}$ to about 10 $hr^{-1}$. Suitable reforming temperatures may be achieved by pre-heating the feed to high temperatures that can range of from about 600° F. (316° C.) to about 1,800° F. (982° C.). The term catalytic reforming as used herein and in the art refers to conversion of hydrocarbons over a reforming catalyst in the absence of added water, (e.g. less than about 1,000 ppm of water). This process differs significantly from steam reforming which entails the addition of significant amounts of water as steam, and is most commonly used to generate synthesis gas from hydrocarbons such as methane.

To achieve the suitable reformer temperatures, it often may be necessary to heat the furnace tubes to high temperatures. These temperatures can often range from about 600° F. (316° C.) to about 1,800° F. (982° C.), alternatively from about 850° F. (454° C.) to about 1,250° F. (677° C.), alternatively from about 900° F. (482° C.) to about 1,200° F. (649° C.).

A multi-functional catalyst composite, which contains a metallic hydrogenation-dehydrogenation component, or mixtures thereof, selected from group VIII of the periodic table of the elements (also known as groups 8, 9, and 10 of the IUPAC periodic table) on a porous inorganic oxide support (such as bound large pore zeolite supports or alumina supports) may be employed in catalytic reforming. Most reforming catalysts are in the form of spheres or cylinders having an average particle diameter or average cross-sectional diameter from about 1/16 inch (1.6 mm) to about 3/16 inch (4.8 mm). Catalyst composites for catalytic reforming are disclosed in U.S. Pat. Nos. 5,674,376 and 5,676,821, incorporated by reference herein.

The disclosed methodologies may also be useful for reforming under low-sulfur conditions using a wide variety of reforming catalysts. Such catalysts include, but are not limited to Noble Group VIII metals on refractory inorganic oxides such as platinum on alumina, Pt/Sn on alumina and Pt/Re on alumina; Noble Group VIII metals on a large pore zeolites such as Pt, Pt/Sn and Pt/Re on large pore zeolites.

In an embodiment, the catalyst may be a sulfur sensitive catalyst such as a large-pore zeolite catalyst comprising at least one alkali or alkaline earth metal charged with at least one Group VIII metal In such an embodiment, the hydrocarbon feed may contain less than about 100 parts per billion by weight (ppb) sulfur, alternatively, less than about 50 ppb sulfur, and alternatively, less than about 25 ppb sulfur. If necessary, a sulfur sorber unit may be employed to remove small excesses of sulfur.

In an embodiment, the catalyst of this disclosure comprises a large-pore zeolite catalyst including an alkali or alkaline earth metal and charged with one or more Group VIII metals. In an alternative embodiment, such a catalyst may be used for reforming a naphtha feed.

The term "large-pore zeolite" as used herein refers to a zeolite having an effective pore diameter of from about 6 Angstroms (Å) to about 15 Å. Large pore crystalline zeolites, which are suitable for use in this disclosure include without limitation the type L zeolite, zeolite X, zeolite Y, ZSM-5, mordenite and faujasite. These have apparent pore sizes on the order of about 7 Å to about 9 Å. In an embodiment, the zeolite may be a type L zeolite.

The composition of type L zeolite expressed in terms of mole ratios of oxides may be represented by the following formula:

$$(0.9–1.3)M_{2/n}O:AL_2O_3(5.2–6.9)SiO_2:yH_2O$$

In the above formula M represents a cation, n represents the valence of M, and y may be any value from 0 to about 9. Zeolite L, its X-ray diffraction pattern, its properties, and methods for its preparation are described in detail in, U.S. Pat. No. 3,216,789, the content of which is hereby incorporated by reference. The actual formula may vary without changing the crystalline structure. In an embodiment, the mole ratio of silicon to aluminum (Si/Al) may vary from about 1.0 to about 3.5.

The chemical formula for zeolite Y expressed in terms of mole ratios of oxides may be written as:

$$(0.7–1.1)Na_2O:Al_2O_3:xSiO_2:yH_2O$$

In the above formula, x is a value greater than about 3 and up to about 6; y may be a value up to about 9. Zeolite Y has a characteristic X-ray powder diffraction pattern, which may be employed with the above formula for identification. Zeolite Y its properties, and methods for its preparation are described in more detail in U.S. Pat. No. 3,130,007, the content of which is hereby incorporated by reference.

Zeolite X is a synthetic crystalline zeolitic molecular sieve which may be represented by the formula:

$$(0.7–1.1)M_{2/n}O:Al_2O_3:(2.0–3.0)SiO_2:yH_2O$$

In the above formula, M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and methods for its preparation are described in detail in U.S. Pat. No. 2,882,244 the content of which is hereby incorporated by reference.

An alkali or alkaline earth metal may be present in the large-pore zeolite. That alkaline earth metal may be potassium, barium, strontium or calcium. The alkaline earth metal may be incorporated into the zeolite by synthesis, impregnation or ion exchange.

The large-pore zeolitic catalysts used in this disclosure are charged with one or more Group VIII metals, such as nickel, ruthenium, rhodium, palladium, iridium or platinum. In an embodiment, the Group VIII metal may be iridium or alternatively platinum. The weight percentage of platinum in the catalyst may be from about 0.1 wt % to about 5 wt %.

Group VIII metals are introduced into large-pore zeolites by synthesis, impregnation or exchange in an aqueous solution of appropriate salt. When it is desired to introduce two Group VIII metals into the zeolite, the operation may be carried out simultaneously or sequentially.

It has been discovered that some zeolitic reforming catalysts evolve hydrogen halide gases upon under reforming conditions, especially during initial operations. These evolving hydrogen halide gases, in turn, can produce aqueous halide solutions in the cooler regions of the process equipment, such as the areas downstream of the reactors. Alternatively, aqueous halides may be produced during start-ups or shutdowns, when this downstream equipment is exposed to moisture. Any austenitic stainless steel sections of this equipment that come in contact with aqueous halide solution may be subject to halide stress-corrosion cracking (HSCC). HSCC is a unique type of corrosion in that there may be essentially no loss of the bulk metal before repair or replacement is necessary.

In an embodiment, HSCC of austenitic stainless steel may be prevented via application of an AML and formation of an MPL. HSCC can occur when austenitic stainless steel contacts aqueous halide at temperatures above about 120° F. (49° C.), alternatively from about 130° F. (54° C.) to about 230° F. (110° C.), while also subjected to tensile stress while not wishing to be bound by theory, it is believed that the cracks caused by HSCC progress by electrochemical dissociation of the steel alloy in the aqueous halide solution.

The need to protect austenitic stainless steel from HSCC is known. Generally, if HSCC conditions are to be encountered, a different type of steel or a special alloy, which may be more expensive than austenitic stainless steel, is selected when the equipment is designed. Alternatively, process conditions can sometimes be modified so that the HSCC does not occur, such as by operating at lower temperatures or drying the process streams. In other situations where the properties of stainless steel are required or highly desirable, means are employed to prevent HSCC. In an embodiment, an AML/MPL may be applied to the stainless steel to eliminate contact of the steel with the halide environment.

Microscopic analysis can readily determine the thickness of the AML or MPL described herein. For ease of measurement of the coating thickness, coupons may be prepared which correspond to the reactor substrate to be treated. These may be treated under identical conditions as the large scale reactor component to be treated. The coupons may be used to determine the thickness of the AML and resulting MPL.

EXAMPLES

In examples 1-13, 347 type stainless steel coupons, generally less than about 2 inches square, were coated with a composition to form an AML on the coupons. The coating composition comprised about 32 wt % tin metal (1-5 μm particle size), about 32 wt % tin oxide (<325 mesh (0.044 $mm^2$)), about 16 wt % tin octanoate, and the balance anhydrous isopropyl alcohol. In some instances one-half of the coupon was coated to determine the migration of the MPL to the uncoated portion of the coupon. Referring to Table I, the coating was cured in a mixture of hydrogen:argon at an about 75:25 mole ratio for about 40 or about 100 hours at the indicated temperatures and pressures. During this process the tin-containing AML formed an MPL comprising stannide on the surface of the coupons. The identification of the MPL formed was determined by mounting the sample in epoxy resin, followed by grinding and polishing for examination with photographic and scanning electron microscopes. Visual and microscopic inspection of the coupon confirmed the formation of an MPL comprising stannide with the characteristics observed in Table I rows 9 and 10.

Curing carried out at about 1,025° F. (552 ° C.) and about 14.7 psia (101 kPa), see examples 5 and 9, served as the conventional curing conditions for comparative purposes. In contrast, examples 1, 3, 7, 10 and 12 had the curing carried out at 1250° F. (677° C.). FIG. 2 is a backscatter SEM image of the MPL produced in Example 10. Specifically, FIG. 2 shows the steel substrate 50, the intermediate nickel-depleted bonding layer comprising stannide inclusions 52, the stannide layer comprising carbide inclusions 54, and the mounting epoxy 56. In some cases, see examples 2, 4 and 8, the coated coupons were further processed by treatment with hydrogen chloride as a mobilization agent.

Examples 11 and 13 formed an MPL comprising stannide after the coupons were subjected to a two step curing procedure performed by curing at a first temperature of about 1,250° F. (677° C.) and a first pressure of about 3.1 psia (21 kPa) for about 40 hours; followed by curing at a second temperature of about 1,250° F. (677° C.) and a second pressure about 0.2 psia (1.3 kPa) for about 10 hours. The MPLs that formed via two step curing, examples 11 and 13, were thicker than that seen when the process was carried out in one step, examples 10 and 12 respectively.

TABLE I

| Example | $H_2$/Ar | Temp ° F. (° C.) | Time hr | Press Psia (kPa) | Time hr | Press Psia (kPa) | HCl | Ave. thickness of stannide layer μm | Thickness of bonding layer μm |
|---|---|---|---|---|---|---|---|---|---|
| .5 | 75/25 | 1025 (552) | 100 | 14.7 (101) | — | — | — | 11 | 0 |
| 9 | 75/25 | 1025 (552) | 40 | 14.7 (101) | — | — | — | 5 | 0 |
| 1 | 75/25 | 1250 (677) | 40 | 0.2 (1.3) | — | — | — | 0 | — |
| 3 | 75/25 | 1250 (677) | 40 | 1.6 (11) | — | — | — | 16 | 2 |
| 7 | 75/25 | 1250 (677) | 40 | 3.1 (21) | 10 | 0.2 (1.3) | — | 15 | — |
| 10 | 75/25 | 1250 (677) | 40 | 8.9 (61) | — | — | — | 50 | 6 |
| 12 | 75/25 | 1250 (677) | 40 | 14.7 (101) | — | — | — | 26 | 3.4 |
| 2 | 75/25 | 1250 (677) | 40 | 0.2 (1.3) | — | — | Yes | Negligible | 0 |
| 4 | 75/25 | 1250 (677) | 40 | 1.6 (11) | — | — | Yes | 27 | 2 |
| 8 | 75/25 | 1250 (677) | 40 | 3.1 (21) | 10 | 0.2 (1.3) | Yes | 35 | 5.7 |
| 11 | 75/25 | 1250 (677) | 40 | 14.7 (101) | 10 | 0.2 (1.3) | — | 55 | 4.2 |
| 13 | 75/25 | 1250 (677) | 40 | 14.7 (101) | 10 | 0.2 (1.3) | — | 30 | 3.4 |

The results demonstrate that MPLs comprising stannide formed after about 40 hours of curing at about 1,250° F. (677° C.) and atmospheric and/or sub-atmospheric pressures have increased thickness when compared to the layers formed in example 5 under the curing conditions of about 1,025° F. (552° C.) and atmospheric pressure. Furthermore, the MPLs comprising stannide formed under elevated temperatures and sub-atmospheric pressures can have a reduced amount of reactive tin as determined by the absence of small metallic tin balls on the surface of the sample when compared to the MPL comprising stannide formed using the curing conditions of example 5.

While preferred embodiments of this disclosure have been shown and described, modifications thereof may be made by one skilled in the art without departing from the spirit and teachings of this disclosure. The embodiments described herein are exemplary only, and are not intended to be limiting. Many variations and modifications of this disclosure disclosed herein are possible and are within the scope of this disclosure. Use of the term "optionally" with respect to any element of a claim is intended to mean that the subject element is required, or alternatively, is not required. Both alternatives are intended to be within the scope of the claim. Use of broader terms such as "comprises", "includes", "having", etc. should be understood to provide support for narrower terms such as "consisting of", "consisting essentially of", "comprised substantially of", etc. Unless specified to the contrary or apparent from the plain meaning of a phrase, the word "or" has the inclusive meaning. The adjectives "first," "second", and so forth are not to be construed as limiting the modified subjects to a particular order in time, space, or both, unless specified to the contrary or apparent from the plain meaning of a phrase.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference herein is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

That which is claimed:

1. A method of treating a substrate, comprising: applying a layer of at least one metal to the substrate of an unassembled component of a structure to form an applied metal layer on the substrate and curing the applied metal layer at sub-atmospheric pressure prior to assembly of the structure to form a metal protective layer on the substrate, wherein the applied metal layer is cured in a reducing environment, wherein the metal protective layer comprises a reactive metal obtained from the substrate and wherein the applied metal layer consists of tin, antimony, bismuth, lead, mercury, arsenic, germanium, indium, tellurium, selenium, thallium, copper, brass, intermetallic alloys, or combinations thereof.

2. The method of claim 1 wherein the applied metal layer is cured at a pressure of from about 14 psia (97 kPa) to about $1.9\times10^{-5}$ psia (0.13 Pa).

3. The method of claim 1 wherein the applied metal layer is cured at a temperature of from about 600° F. to about 1,400° F. (760° C.).

4. The method of claim 1 wherein the applied metal layer has a thickness of from about 1 mil (25 μm) to about 100 mils (2.5 mm).

5. The method of claim 1 wherein the metal protective layer has a thickness of from about 1 μm to about 150 μm.

6. The method of claim 1 further comprising contacting the metal protective layer with a mobilization agent followed by a sequestration process.

7. The method of claim 1 wherein the metal protective layer further comprises a nickel-depleted bonding layer.

8. The method of claim 7 wherein the bonding layer comprises stannide.

9. The method of claim 7 wherein the bonding layer has a thickness of about 1 to about 100 μm.

10. The method of claim 7 wherein the bonding layer comprises from about 1 wt % to about 20 wt % elemental tin.

11. The method of claim 1 wherein the application of the layer of at least one metal, the curing of the applied metal layer, or both is performed at a location other than a final assembly site for the structure.

12. The method of claim 1 wherein the unassembled component is transported prior to or after applying the at least one metal layer; prior to or after curing of the applied metal layer; or prior to or after further contacting the metal protective layer with a mobilization agent followed by a sequestration process.

13. A method of treating a substrate, comprising: applying a layer of at least one metal to the substrate of an unassembled component of a structure to form an applied metal layer on the substrate, curing the applied metal layer on the unassembled component at a first temperature and a first pressure for a first period of time, and curing the applied metal layer on the unassembled component at a second temperature and second pressure for a second period of time, wherein the curing forms a metal protective layer on the substrate, wherein the applied metal layer is cured in a reducing environment, wherein the first pressure, the second pressure, or both are sub-atmospheric, and wherein the metal protective layer comprises a reactive metal obtained from the substrate, and wherein the applied metal layer consists of tin, antimony, bismuth, lead, mercury, arsenic, germanium, indium, tellurium, selenium, thallium, copper, brass, intermetallic alloys, or combinations thereof.

14. The method of claim 13 wherein the first temperature is from about 600° F. to about 1,400° F. (760° C.) and the first pressure is from about 215 psia (1,480 kPa) to about $1.9\times10^{-5}$ psia (0.13 Pa).

15. The method of claim 13 wherein the second temperature is from about 600° F. to about 1,400° F. (760° C.) and the second pressure is from about $1.9\times10^{-5}$ psia (0.13 Pa) to about 215 psia (1,480 kPa).

16. A method of treating a substrate, comprising: applying a layer of at least one metal to the substrate of an unassembled component of a structure to form an applied metal layer on the substrate and followed by curing of the applied metal layer at a temperature of greater than about 1,200° F. (649° C.) and in a reducing environment to form a metal protective layer on the substrate, wherein the applied metal layer consists of tin oxide, a decomposable tin compound, and tin metal powder, and wherein the first pressure, the second pressure, or both are sub-atmospheric, and wherein the metal protective layer comprises a reactive metal obtained from the substrate.

17. A process for manufacturing a petrochemical product comprising catalytically reacting a feed stock in the reactor having a metal protective layer produced by the method of claim 1 and recovering the petrochemical product from the reactor.

18. The method of claim 13, wherein curing the applied metal layer at the first temperature and the first pressure for the first period of time occurs prior to assembly of the structure.

19. The method of claim 13, wherein the first period of time is from about 1 hour to about 150 hours and the second period of time is from about 1 hour to about 120 hours.

20. The method of claim 1, wherein the reducing environment comprises hydrogen, carbon monoxide, hydrocarbons, or combinations thereof.

* * * * *

UNITED STATES PATENT AND TRADEMARK OFFICE

CERTIFICATE OF CORRECTION

PATENT NO. : 8,119,203 B2
APPLICATION NO. : 11/420904
DATED : February 21, 2012
INVENTOR(S) : Robert L. Hise et al.

It is certified that error appears in the above-identified patent and that said Letters Patent is hereby corrected as shown below:

In the Specification:

Column 1, line 44, replace “terns” with --terms--
Column 2, line 22, replace “CPL” with --MPL--
Column 5, line 49, replace “embodiment” with --embodiments--
Column 6, line 30, replace “substance The” with --substance. The--
Column 6, line 48, replace “Theological” with --rheological--
Column 7, line 15, replace “thereof The” with --thereof. The--
Column 7, line 55, replace “insure” with --ensure--
Column 8, line 17, replace “flrther” with --further--
Column 8, line 30, replace “thereof Examples” with --thereof. Examples--
Column 9, line 64, replace “nmcrostructure” with --microstructure--
Column 10, line 53, replace “thereof The” with --thereof. The--
Column 13, line 26, replace “thereof The” with --thereof. The--
Column 13, line 36, replace “fiirther” with --further--
Column 13, line 41, replace “fiurher” with --further--
Column 13, line 57, replace “to, a” with --to a--
Column 14, line 3, replace “fierier” with --further--
Column 14, line 52, replace “with compound” with --with a compound--
Column 15, line 6, replace “tunings” with --turnings--
Column 15, line 9, replace “thereof In” with --thereof. In--
Column 15, line 18, replace “thereof Water” with --thereof. Water--

Signed and Sealed this
First Day of October, 2013

Teresa Stanek Rea
*Deputy Director of the United States Patent and Trademark Office*